United States Patent [19]

Miura

[11] Patent Number: 5,024,577

[45] Date of Patent: Jun. 18, 1991

[54] PAPER ARRANGING SYSTEM

[76] Inventor: Isamu Miura, 16-6, Ryusen 3-chome, Taitoh-ku, Tokyo, Japan

[21] Appl. No.: 375,438

[22] Filed: Jul. 5, 1989

[51] Int. Cl.[5] ..... B65H 29/22

[52] U.S. Cl. ..... 414/788.4; 414/796.4; 414/930; 414/789.1; 414/796.7

[58] Field of Search ..... 414/788.4, 788.6, 789.5, 414/796.4, 796, 795.9, 797.2, 797.3, 796.7, 789.1, 792.7, 795.4, 795.8, 796.2, 508, 930, 754, 757, 787; 271/186, 211, 215, 217, 221

[56] References Cited

U.S. PATENT DOCUMENTS

| | | | |
|---|---|---|---|
| 4,073,388 | 2/1978 | Carter | 414/930 X |
| 4,585,225 | 4/1986 | Miura | 271/221 X |
| 4,768,912 | 9/1988 | Miura | 414/788.4 |
| 4,886,262 | 12/1989 | Miura | 414/796.4 X |

FOREIGN PATENT DOCUMENTS

| | | | |
|---|---|---|---|
| 3816162 | 11/1988 | Fed. Rep. of Germany | 414/930 |

*Primary Examiner*—Frank E. Werner

*Assistant Examiner*—James T. Eller, Jr.

*Attorney, Agent, or Firm*—Schwartz & Weinrieb

[57] ABSTRACT

A paper arranging system for re-loading or re-stacking a bundle of paper sheets from a paper feed rack to a paper arranging device has a bridge plate interposed between the paper feed rack and the paper arranging device so as to bridge the space defined between the paper feed rack and the paper arranging device. In addition, a working platform is disposed in front of the paper feed rack, the bridge plate, and the paper arranging device so as to operatively support a workman at the working platform station for performance of the paper re-loading or re-stacking operation. The working platform is pivotable between a first horizontally disposed working or support position, and a second vertically disposed inoperative position so that free access to the front regions of the paper feed rack and the paper arranging device is provided. A vibration device is also provided within the paper arranging device so as to assist in the uniform alignment of at least two sides of the stacked paper sheets and the intervening corner region defined therebetween.

11 Claims, 10 Drawing Sheets

PAPER ARRANGING SYSTEM

FIELD OF THE INVENTION

This invention relates to a paper arranging system capable of stacking a plurality of paper sheets with their corners neatly arranged with respect to each other, and more particularly to an automatic paper arranging system consisting of a paper arranging device, a paper feed rack, a bridge plate device, a reversing paper feeder, and a working platform.

BACKGROUND OF THE INVENTION

In the case where printing upon paper is to be done using an automatic printing machine, it is necessary to feed paper into the printing machine under constant or uniform conditions, or alternatively, in the same mode. Also in the case where paper sheets of different sizes are to be cut to the same size, it is necessary to arrange the sheets with respect to each other such that at least two sides of the sheets are properly aligned. These paper arranging operations have conventionally been done entirely by means of manual labor. When a heavy load of paper is to be handled, it is indeed very difficult to perform, and such required labor requiring a lot of time with a very poor degree of efficiency. Moreover, such manual operations often led to operational and efficiency difficulties, such as, for example, crushed or wrinkled corners as may be caused by dropping the sheets during a reversing operation, thus leading to a non-uniform arrangement of the papers.

For these reasons, the applicant of this invention has previously made a study of paper arranging devices capable of automatically and uniformly stacking loaded sheets of paper by loading a bundle of sheets from an overhead position, and thereby endeavoring to improve the working efficiency of such systems.

This system is designed to re-load a bundle of sheets in an incremental mode from a paper feed rack installed adjacent to the paper arranging device. In this system, the bundle of sheets was slid over a bridge plate device spanning a gap defined between the paper feed rack and the paper arranging device, and into the paper arranging device. Moreover, the bundle of sheets was fed into the paper arranging device in an overturned state by means of a reversing device.

However, since the paper arranging device of the above-mentioned structure was too large in height from its installed level to the paper re-loading position, its lower half portion had to be partially embedded beneath the floor level or, alternatively, an elevated working platform upon which a worker is disposed had to be provided.

Therefore, in the former case, the floor of the factory must be re-constructed for the purpose of installing the device, thus leading sometimes to the case where it is impossible to install the device because the building cannot be reconstructed due to its structural characteristics. Moreover, in the latter case, the working platform is positioned in front of the device, thus leading to the difficulty of carrying the paper to and from the paper feed rack and the paper arranging device. In addition, since the working position is higher, there is greater danger to the operating personnel disposed at such an elevated level, and in addition, more inconvenience and loss of efficiency with respect to constant operating time should, for example, the papers be dropped.

OBJECTS OF THE INVENTION

This invention has been made with a view toward solving the foregoing problems, and accordingly an object of this invention is to provide a paper arranging system which is capable of sliding a bundle of paper sheets from a paper feed rack and across a bridge plate toward a paper arranging device, reversing the bundle, and stacking the same upon the paper arranging device, which can perform a paper arranging process by means of a simple operation, which permits simplified installation thereof and easy transportation of the paper sheets, and is superior in safety and operational efficiency.

Another object of this invention is to provide a reversing mechanism of simple construction which can reverse a bundle of sheets without causing operational difficulties, such as, for example, wrinkling and folding of the paper sheets, by means of a simple operation and which can feed air between the sheets simultaneously with the reversal operation while the bundle of sheets is being slid across the bridge plate from the paper feed rack toward the paper arranging device.

One more object of this invention is to provide a lifting mechanism for supporting and holding the stacked sheets of a heavy paper load at a predetermined level with safety and accuracy.

SUMMARY OF THE INVENTION

In order to achieve the foregoing objects, the paper arranging system of this invention is such that simultaneously with the re-loading of the bundle of sheets of paper from the paper feed rack onto the paper arranging device, a vibration plate installed upon the inner wall of the paper arranging device is vibrated by means of a vibrator so as to arrange or align the sheets along two sides thereof and with respect to the corner defined therebetween, and to stack them during the re-loading operation. In this system, a working platform of proper height is installed in front of the paper feed rack and the paper arranging device in such a manner that it can be freely turned about one end thereof by means of a platform plate kickup motor to alternative overturn or standup positions.

The paper feed rack and paper arranging device should preferably be placed adjacent to each other, with a predetermined angle defined therebetween, at the forward or front portions thereof. Moreover, it is possible to install a plate holder along the side of and contiguous to the paper feed rack so as to control and drive a lifting frame for vertically elevating in an upward and downward mode a paper loading plate. The lifting frame for loading the paper onto the paper feed rack and the paper arranging device can be designed to constitute a preferred embodiment by fixing the bases of a multiple number of forwardly extending forked rods to the supporting rods disposed transversely at the rear end of such frame in such a manner as to permit slidable adjustment of the forked rods so as to properly support the paper loading plate upon the upper surface of such forked rods.

Furthermore, it is possible to install a reversing mechanism, which includes a reversing shaft comprising a roll having a predetermined external diameter and disposed horizontally in a cantilevered manner, above the bridge plate device spanning the gap defined between the paper feed rack and the paper arranging device so as to intersect the paper feed direction and which is rotationally driven by means of a suitable rotary drive unit in the direction opposite to the paper feed direction upon the bridge plate, and a keeper disk disposed in such a manner with respect to the reversing roll as to be freely pivotable into and out of contact with the surface of the roll and to be pressed as a paper pressing means against such roll surface according to the timing of the paper feed to the roll.

The lifting frame loading paper or for loading the paper loading plates upon the paper feed rack, the paper arranging device and the plate holder is such that a vertically extending guide rail is respectively fixed within each device, a bearing roller mounted upon the lifting frame is disposed in a sliding contact manner upon such guide rail for the purpose of controlling or fixing the movements of the paper or plates in the depth and width directions, and the front and rear sides are suspended by means of a chain, respectively. The two chains are respectively passed through a support chain wheel disposed above them and then engaged with a drive chain wheel disposed upon opposite ends of a drive shaft disposed in a bridged manner within opposite sides of the respective device or component of the overall apparatus or system. The free ends of such two chains are respectively suspended over the drive chain wheel and connected to a lifting mechanism for driving the drive shaft in a normal or reverse direction by means of a rotational drive means such as, for example, a motor.

In the rear of the paper feed rack, at the desired paper feed level, it is preferable to install a mirror for checking the back side of the loaded paper.

The paper arranging system is so designed as to ensure that in the paper stacking system consisting of a paper arranging device, a paper feed rack, a bridge plate device, a reversing paper feeder, a plate holder and a working platform, as well as a central control unit for controlling and driving these devices, the transportation of the paper into and out of the devices can be performed at the floor level because the working platform was constructed so as to be freely foldable, thus removing it from the front of the paper arranging device, the paper feed rack and the plate holder.

Moreover, since the lifting frame for loading the paper onto the paper feed rack and the paper arranging device is of such construction that the bases of the multiple number of forwardly extending forked rods fixed to the transversely disposed supporting rods, which are fixed to the rear end of such frame, are mounted so as to permit adjustment of the sliding position thereof, any forklift can be used without interference with the apparatus during the time of transporting the paper into and out of the apparatus, thus ensuring easy operation.

Furthermore, since the reversing paper feed device installed upon the bridge plate device releases a worker from the necessity of bearing the total weight of the bundled sheets by himself, such a system leads to improved efficiency of operation.

In addition, since the lifting frame for the paper arranging device, the paper feed rack and the plate holder is composed of a lifting mechanism suspended by means of chains, it is simplified in construction and is able to perform slip-free positive position control.

BRIEF DESCRIPTION OF THE DRAWINGS

Various other features and attendant advantages of the present invention will become more apparent from the following detailed description, when considered in connection with the accompanying drawings, in which like reference characters designate like or corresponding parts throughout the several views, and wherein.

DETAILED DESCRIPTION OF THE PREFERRED EMBODIMENT

Figure 1:
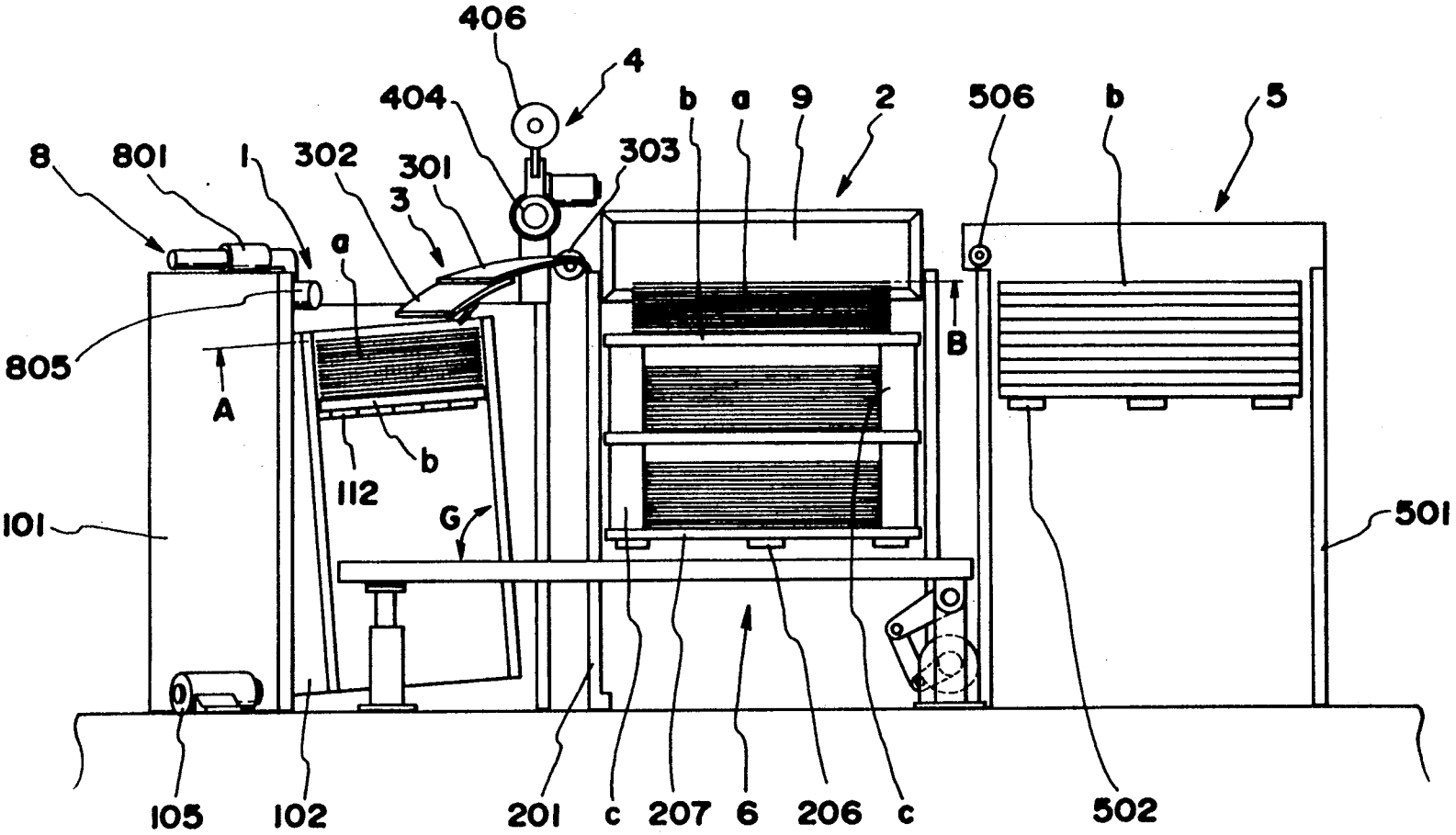
FIG. 1 is a front view showing the general arrangement of one embodiment of the paper arranging system of the present invention.

The paper arranging system of the present invention comprises a paper arranging device 1, a paper feed rack 2, a bridge plate device 3 installed therebetween, a paper reversing feed device 4 installed above the bridge plate 3, a plate holder 5 installed along the side of paper feed rack 2 and a working platform 6 installed in front of these devices, as well as a central control unit (not shown) for controlling and driving all of such devices.

Paper arranging device 1 constitutes, as shown in FIG. 3 to FIG. 6, a paper loading frame of the front-open type consisting of a machine frame 101, an inclined frame 102 supported in a tilted manner upon machine frame 101, and a lifting frame 103 vertically reciprocable along inclined frame 102. Inclined frame 102 is so installed that its left rear corner facing the front of the apparatus may be lowered through means of tilting support means 104 consisting of a tilting support shaft inserted in between the lower end of this frame and machine frame 101. Inclined frame 102 can be disposed in a titled position or a vertically erect position by tilting drive means 105 consisting of a motor, cam, and the like, to be driven by means of a control signal from the central control unit.

Figure 7:
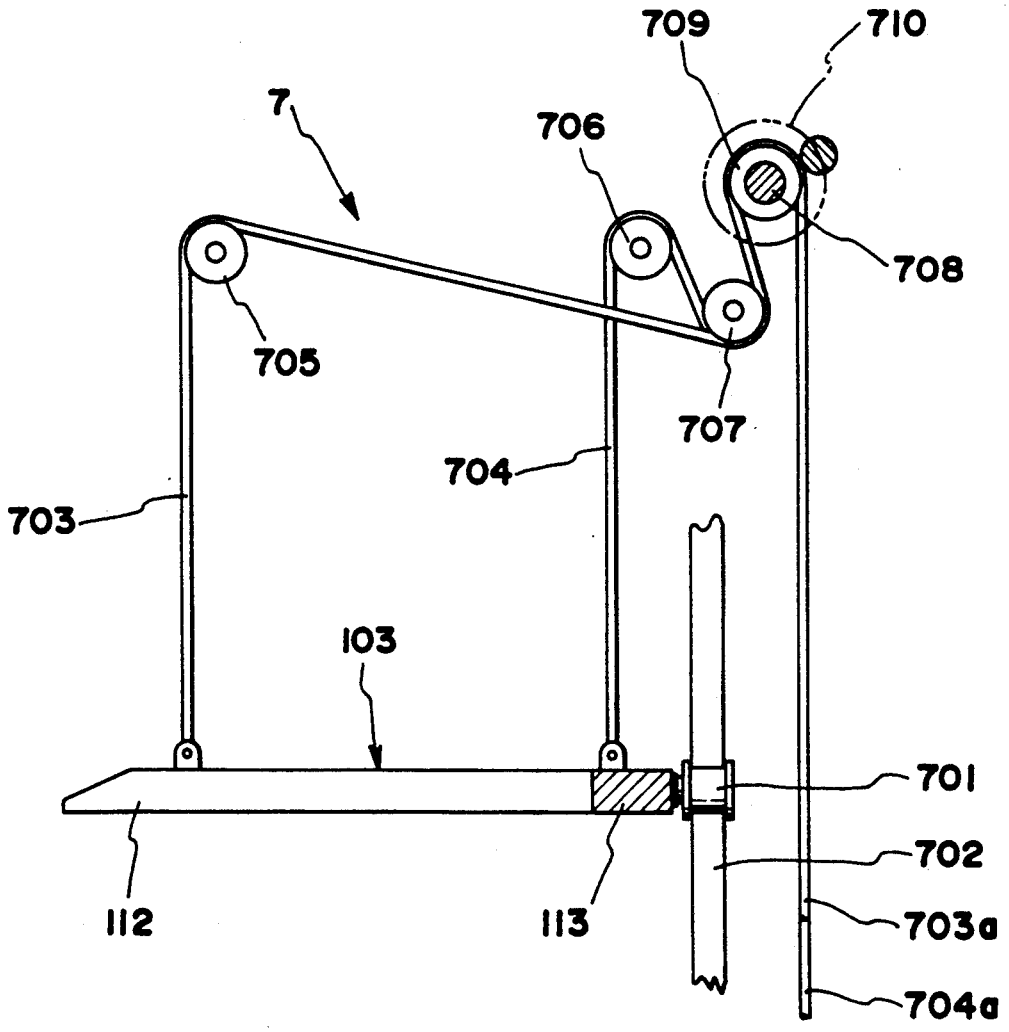
FIG. 7 is a front view of the lifting mechanism employed within the paper arranging device of FIG. 3.

Upon the inner surfaces of side plates upon the left side and back side of inclined frame 102, vibration plates 106, 106 are respectively disposed at the position of loading level A, and are vibrated respectively by means of a vibrating mechanism 107 such as, for example, a motor with a small stroke toward the loading face. Moreover, the lifting frame 103 is suspended by means of a lifting mechanism 7 (refer to FIG. 7). Upon the horizontally disposed rod 113 of lifting frame 103 upon which a multiple number of forked rods 112 are installed, two sets of bearing rollers 701, 701 are disposed opposite to each other in a freely rotatable manner. Upon the back plate of the inclined frame 102, a pair of vertically disposed guide rails 702, 702 are fixed longitudinally parallel to each other at a position corresponding to the position of the bearing rollers 701. Flanged portions 701*a*, 701*a* formed upon the outer periphery of each bearing roller 701 are disposed facing each other in a freely rollable manner so as to engage with the shoulders of the guide rails 702 of rectangular section, thus controlling the movements of lifting frame 103 in the depth and width directions. The numerals 114, 114 denote longitudinally extending frames fixed upon both sides of the horizontally disposed rod 113. These two frames 114, along with rod 113 are suspended by means of separate chains 703, 704 at their front and rear side ends, respectively and are suspended by means of support chain wheels 705, 706 disposed in a freely rotatable manner upon the side walls of inclined frame 102 at locations directly above the attachment points upon the frames 113/114. Chains 703, 704 passing over these support chain wheels 705, 706 are passed about an intermediate chain wheel 707 provided with two sets of gears and are engaged with each gear of one of the drive chain wheels 709, 709 which are disposed upon both ends of transverse drive shaft 708 in a freely rotatable manner between rear upper ends of the two side walls of inclined frame 102 so that their free ends 703*a*, 704*a* may be suspended from the drive chain wheels 709, respectively. Upon the drive chain wheels 709 disposed upon the drive shaft 708, the sets of chains connected to the lifting frame 103 thus suspend lifting frame 103. Moreover, a motor 710 for driving shaft 708 rotatably connected to one end of the drive shaft 708. Turning of the motor 710 in normal or reverse directions causes the drive chain wheels 709, 709 disposed upon drive shaft 708 to turn synchronously with the result that the four chains 703, 704 are moved through means of the same stroke so as to move lifting frame 103 in an up and down mode with the orientation of frame 103 being maintained constant with respect to the surrounding apparatus.

At the paper loading level A of the inclined frame 102, a paper position detection sensor (not shown) is provided. This sensor serves to control and stop the normal or reverse rotation of the motor 710 for rotary drive thereof through means of the central control unit in such manner as to ensure that the upper surface of paper a loaded upon lifting frame 103 may always be maintained at the level A. Furthermore, forked rods 112 of the lifting frame 103 are fixed at their bases to horizontally disposed rod 113 in such a manner that the sliding position of each rod 112 is adjustable, thus ensuring that pallet b may be placed and supported upon the upper surface of the forked rods 112 when the apparatus is being used.

Figure 8:
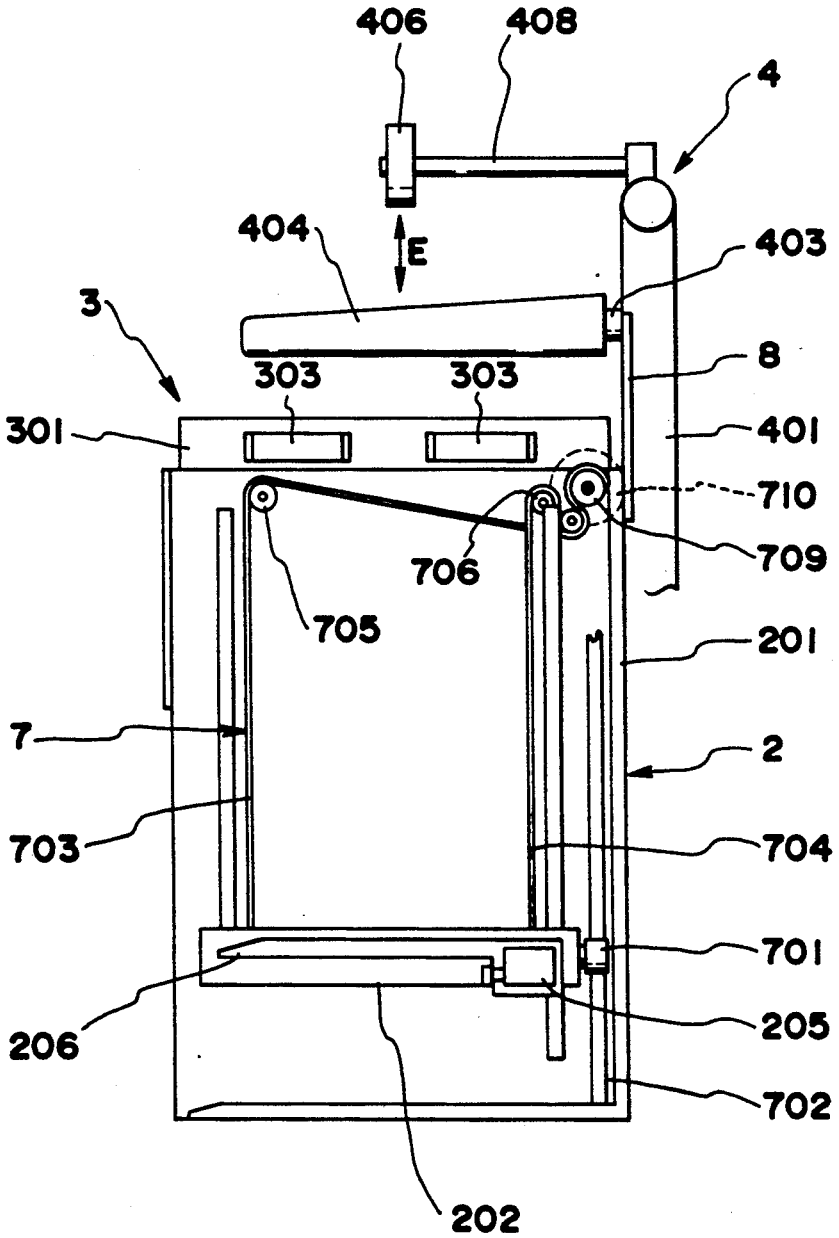
FIG. 8 is a longitudinal section showing one embodiment of the paper feed rack.

The paper feed rack 2 is, as is shown in FIG. 8, composed of machine frame 201 and lifting frame 202 so as to constitute a paper loading frame of the front-open type, and is arranged toward the front of the apparatus so as to be disposed at a position adjacent to the paper arranging device 1. Lifting frame 202 is suspended and supported by means of a lifting mechanism 7 (shown by the same numeral) which is similar to the lifting mechanism 7 for the paper arranging device 1, and is driven in the normal or reverse directions by means of motor 710 so as to move upwardly and downwardly. At the paper feed level B of the machine frame 201, a paper position detection sensor (not shown) is provided. This sensor serves to control and stop the normal or reverse drive of the motor 710 through means of the central control unit in such a manner as to ensure that the upper surface of paper a loaded upon lifting frame 202 may always be maintained at the level B. Also within the lifting frame 202, as in the case of the paper arranging device 1, a multiple number of forwardly extending forked rods 206 have their rear ends connected to horizontal rod 205 disposed transversely across the rear end of the frame in such a manner as to permit the slidable adjustment of sliding the rods 206, thus ensuring that paper a may be loaded through means of a paper loading plate 207 onto pallet b placed upon the upper surface of the forked rods 206.

Figure 9:
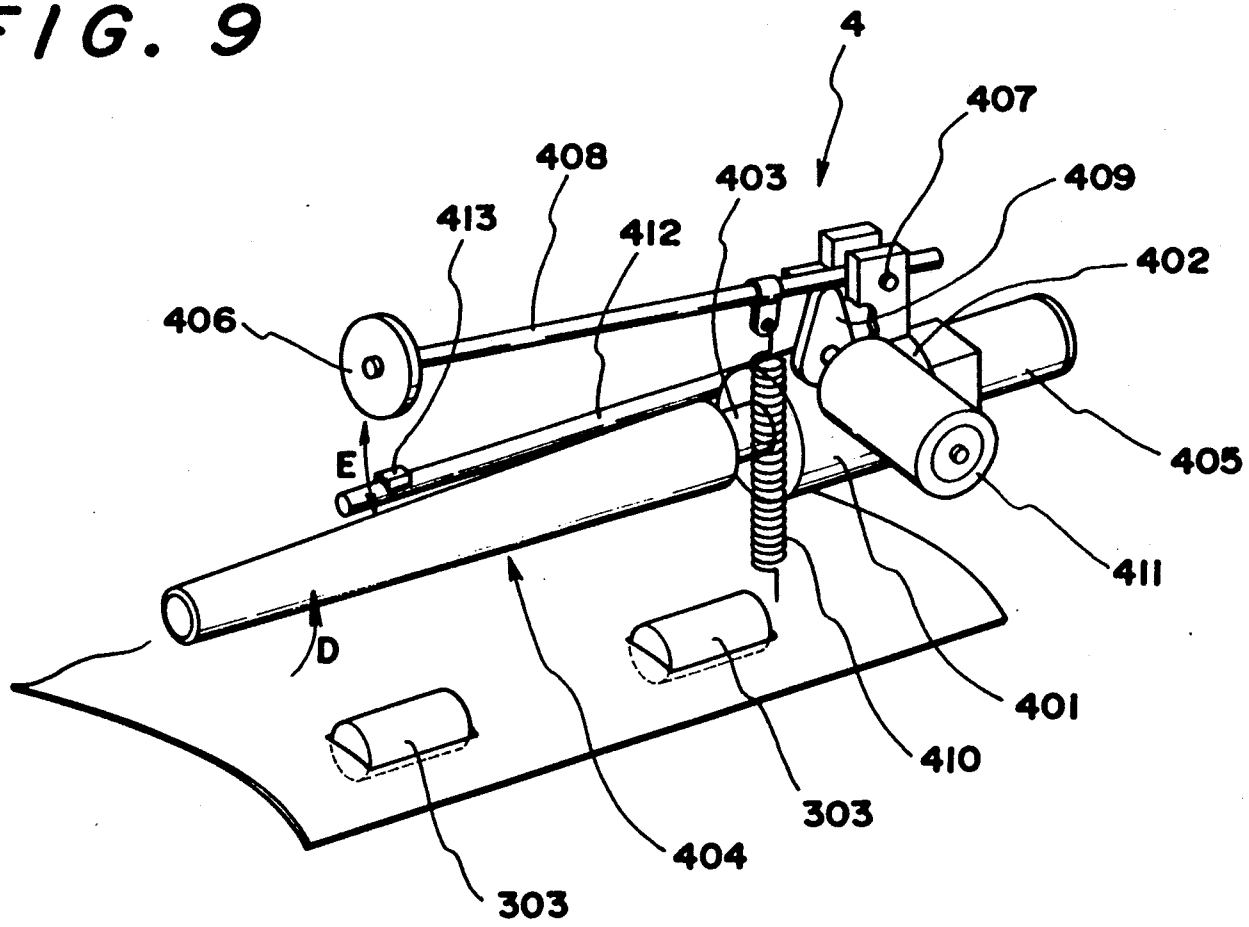
FIG. 9 is a perspective view showing one embodiment of the bridge plate device and paper reversing feed device.
Figure 10:
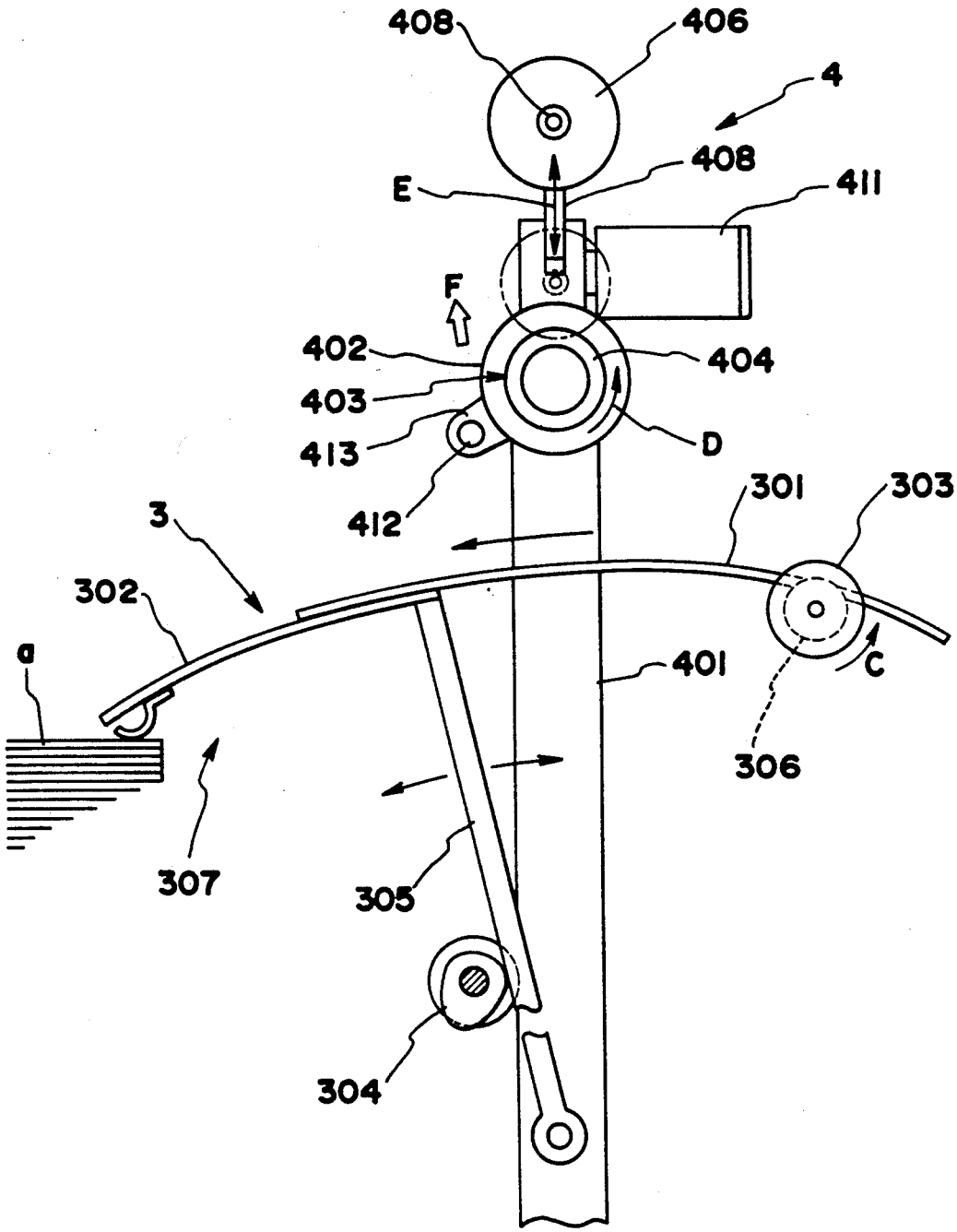
FIG. 10 is a front view showing one embodiment of the bridge plate device and paper reversing feed device.

The bridge plate device 3 is, as is shown in FIG. 9 and FIG. 10, installed between the upper ends of the paper arranging device 1 and the paper feed rack 2, and is composed of a main plate 301 and a sub plate 302 which are disposed so as to be disposed at slightly higher level than that of the paper feed level B of paper feed rack 2 and the loading level A of paper arranging device 1, respectively, and a plurality of paper feed rollers 303. Sub plate 302 is freely housed beneath the bottom surface of main plate 301 which is fixed to machine frame 201 of paper feed rack 2, and is pivotably mounted upon upstanding support frame 401 by means of support arm 305. The sub plate is so designed that it may be moved forwardly or backwardly toward or away from the end of paper arranging device 1 by means of drive mechanism 304 which is composed of a reciprocating means such as, for example, a cam mechanism disposed adjacent to the movable support arm 305 and a driving means such as, for example, a motor. The main plate 301 and sub plate 302 are fan-shaped as viewed in a plan view and constitute a fan angle corresponding to the inward partially surrounding arrangement of paper arranging device 1 and paper feed rack 2 with respect to the operator station. Moreover, upon the surface of main plate 301 upon the side of paper feed rack 2, paper feed rollers 303, 303 having an axis of rotation extending along the generating line of the fan angle are provided in such a manner that their partially cylindrical peripheries are exposed above the upper surface of main plate 301, and are driven rotationally by means of motor 306 in the paper feed direction (Arrow C). The sliding surface of each paper feed roller 303 is made of soft synthetic resin. Upon the bottom surface of the sub plate 302, a paper keeping mechanism 307 for pressing and keeping the upper front end of paper a, fed to paper arranging device 1 according to the timing of the paper feed, in an organized stack, is provided.

Reversing paper feed device 4 is installed above the bridge plate device 3, and consists of reversing shaft 403 extending transversely across the paper feed line of the bridge plate device 3 and mounted in a freely rotatable and cantilevered manner upon bearing piece 402 protrudingly mounted upon machine frame 201 of the paper feed rack 2 or fixed to support frame 401 installed upon the floor. The reversing shaft 403 forms a gently conical roll 404 which is larger in diameter at the supported side and gradually decreases in diameter toward the non-supported end, is disposed approximately 10 to 20 cm above the sliding surface of bridge plate device 3 and is driven rotationally by means of motor 405, which is fixed to the support frame 401, at a predetermined speed in the reverse direction (Arrow D) with respect to the paper feed direction (Arrow C) of the paper conveyed upon bridge plate device 3. The numeral 406 denotes a keeper disk pivotably disposed above the approximate axial center of the roll 404. This keeper disk is pivotably mounted at one end to the support frame 401 through means of a pin shaft 407 and is mounted in a freely pivotable manner to the forward end of support shaft 408 which is freely reciprocable in the direction of Arrow E.

Keeper disk 406 is thus brought into or out of contact with the periphery of roll 404 by means of a rotary cam member 409 provided within the vicinity of the rear end of the support shaft 408 and the elasticity of coil spring 410. The cam member 409 is mounted upon the motor shaft of control motor 411 fixed upon the support frame 401 and serves to move the keeper disk 406 toward and away from the periphery of roll 404 according to the timing of the detection of paper a as determined by means of a paper detection sensor 413 to be hereinafter described. The numeral 412 denotes a sensor supporting bar disposed close to and parallel with the reversing shaft 403 and disposed toward the side of paper arranging device 1. At the end of bar 412, paper detection sensor 413 consisting of a pair of light emitting/receiving elements is provided so as to detect the end of paper a going beyond the upper side of roll 404 and toward the paper arranging device 1 in the lateral direction at the position indicated by Arrow F. When the paper detection sensor 413 detects the paper end, control motor 411 is driven so as to actuate cam member 409 such that the latter no longer acts upon shaft 408 whereby the latter can move downwardly under the influence of spring 410 and thereby press keeper disk 406 against the surface of roll 404.

Figure 11:
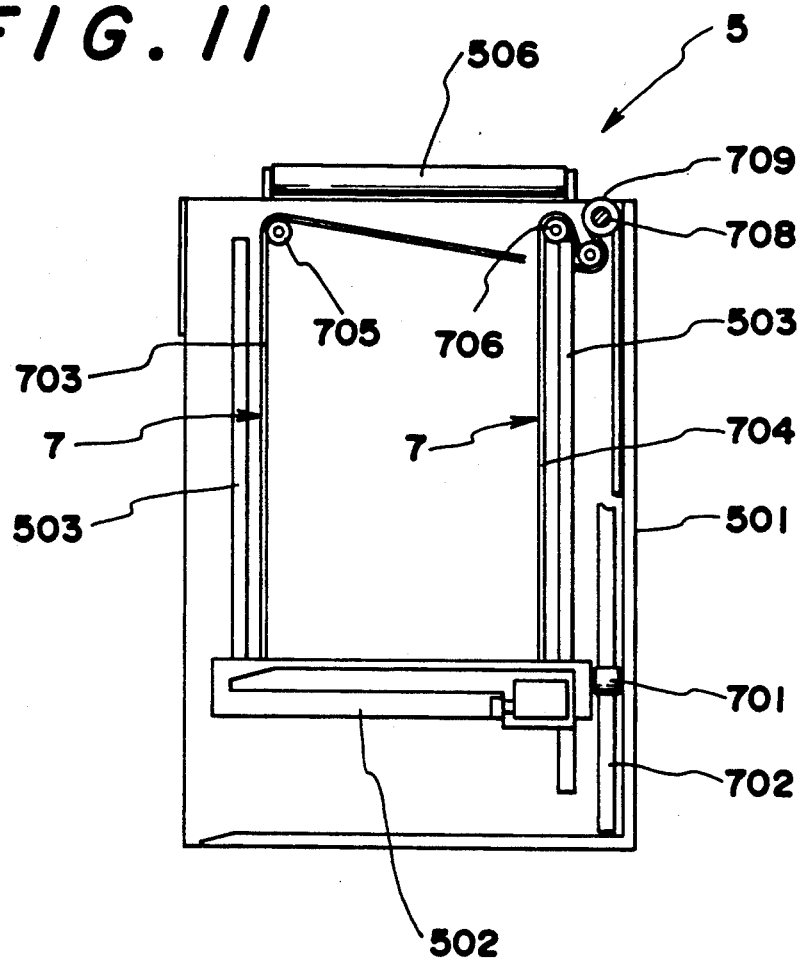
FIG. 11 is a longitudinal section showing one embodiment of the plate holder.

Plate holder 5 is, as in shown in FIG. 11, composed of machine frame 501 and lifting frame 502 so as to constitute a loading frame of the front-open type for paper loading plates and is positioned close to and along the side of the paper feed rack 2 on the side of rack 2 which is opposite the side along which the paper arranging device 1 is disposed. Lifting frame 502 is suspended and supported through means of a lifting mechanism 7 (shown by the same numeral) which is similar to the lifting mechanism for the paper arranging device 1, and is driven as a result of the normal or reverse driving operation of motor 710 such that frame 502 will move upwardly and downwardly. It is mounted upon and supported in a freely slidable manner within guide frame 503 provided upon machine frame 501 and is linked with a lifting chain 504 routed through the machine frame 501 so as to drive the lifting frame 502 by means of a lifting motor 710. At the upper end of the machine frame 501, a paper loading plate position detection sensor (not shown) is provided. This sensor serves to control and stop the normal or reverse operation of rotary drive motor 710 for the lifting frame 502 through means of the central control unit in such a manner as to ensure that the upper surface of the paper loading plate loaded upon the lifting frame 502 may always be substantially maintained at a predetermined level. Furthermore, the numeral 506 denotes a guide roller disposed transversely in a freely rotatable manner at the upper end of machine frame 501 upon the side disposed toward paper feed rack 2. This roller is so constructed that paper loading plate b loaded upon paper feed rack 2 may be slid onto lifting frame 502 within machine frame 501.

Figure 12:
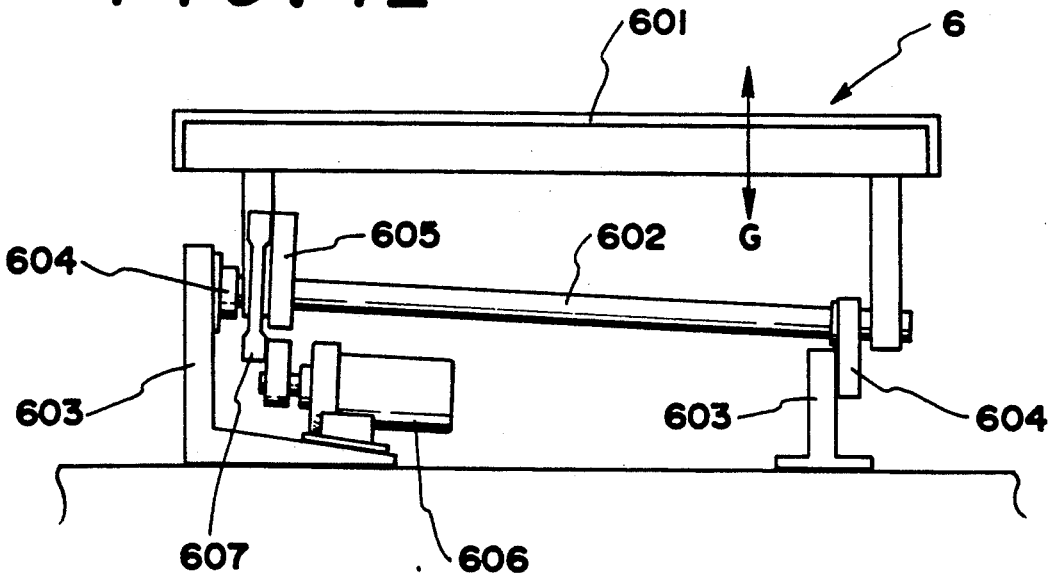
FIG. 12 is a front view showing the main portion of the driving mechanism for the working platform.

Furthermore, working platform 6 is, as is clear from its main construction shown in FIG. 12, such that rotary shaft 602 connected to one end of platform plate 601 is connected to bearing piece 604 provided within the upper end of base 603 fixed upon the floor at a position adjacent to and in front of paper feed rack 2 and paper arranging device 1 in such a manner as to be freely movable in the direction of Arrow G, while the end of arm 605 protruding transversely from the rotary shaft 602 is connected to crank mechanism 607 which is, in turn, connected to the drive shaft of a platform plate kickup motor 606. The platform plate 601 is positioned in front of paper arranging device 1 and paper feed rack 2 is pivoted downwardly to a horizontal position so as to maintain the platform at a level whereby the optimal working height may be secured with respect to the loading level A. Furthermore, the rotary shaft 602 is inclined with resect to the floor level, and the edge of the plate 601 is tilted toward the front side of the machine frame of the device when platform plate 601 is disposed vertically, thus resulting in its removal from the front of the paper arranging device 1, paper feed rack 2 and plate holder 5.

Figure 2:
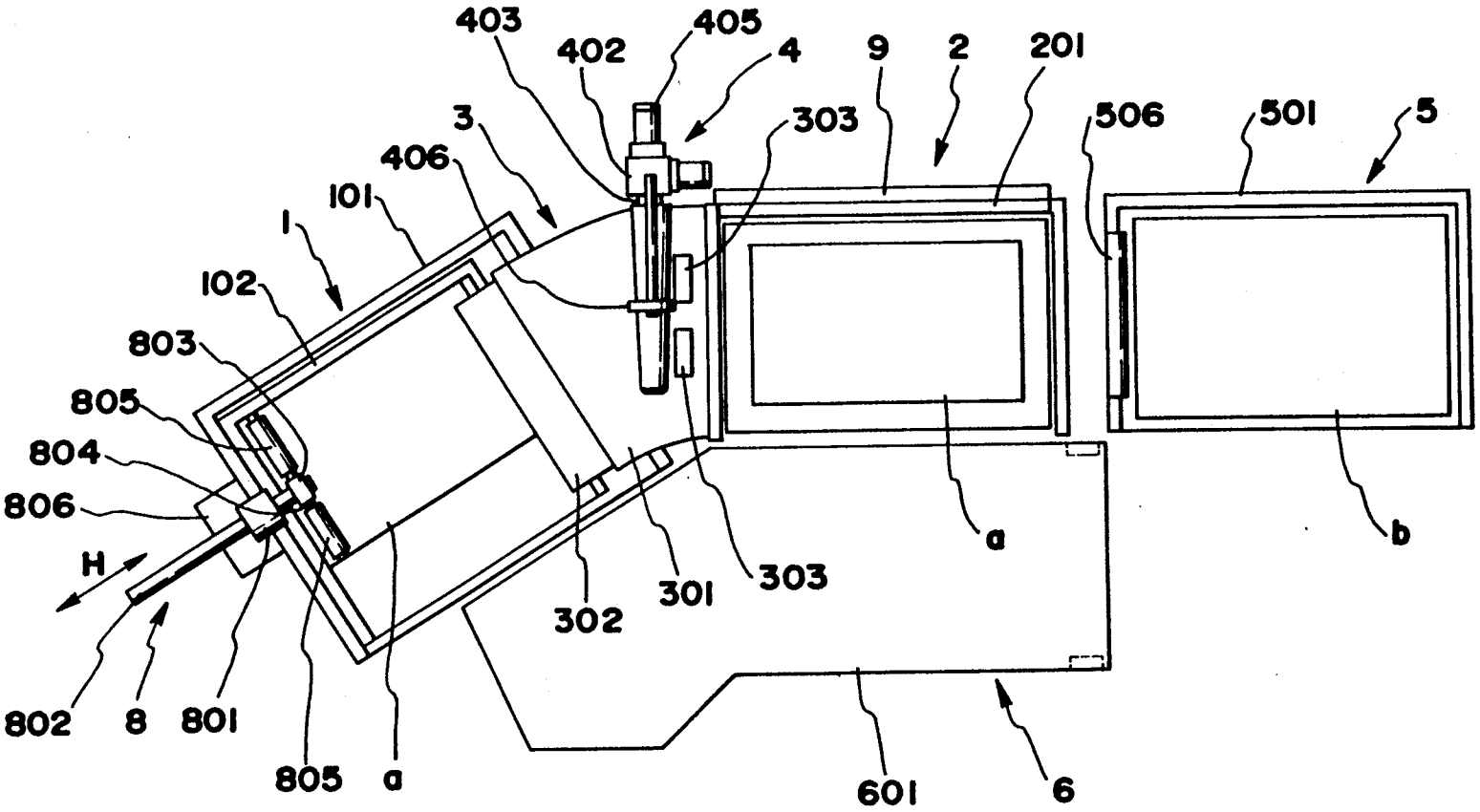
FIG. 2 is a top view showing the general arrangement of one embodiment of the paper arranging system of the present invention.
Figure 3:
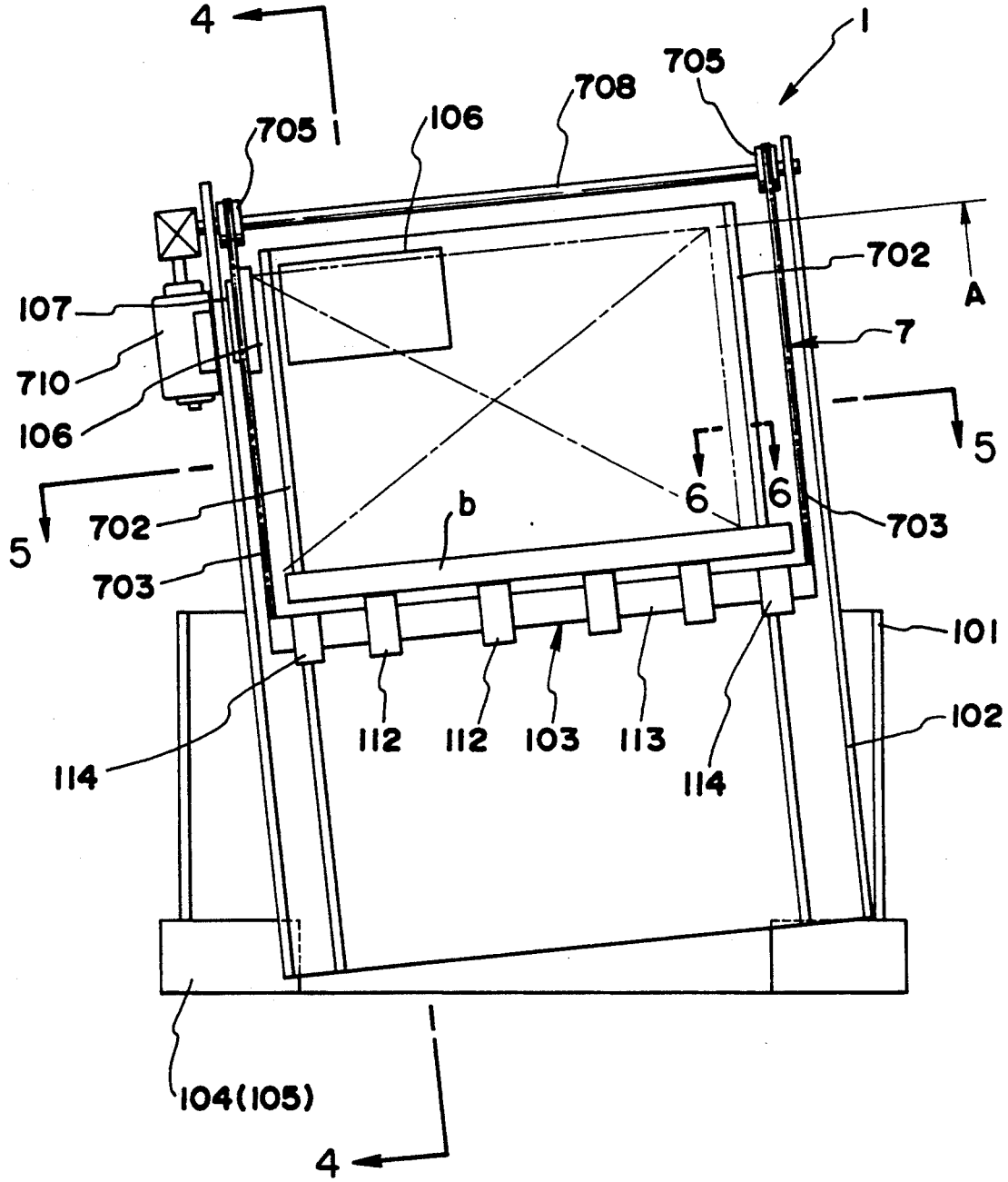
FIG. 3 is a front view showing one embodiment of the paper arranging device.
Figure 4:
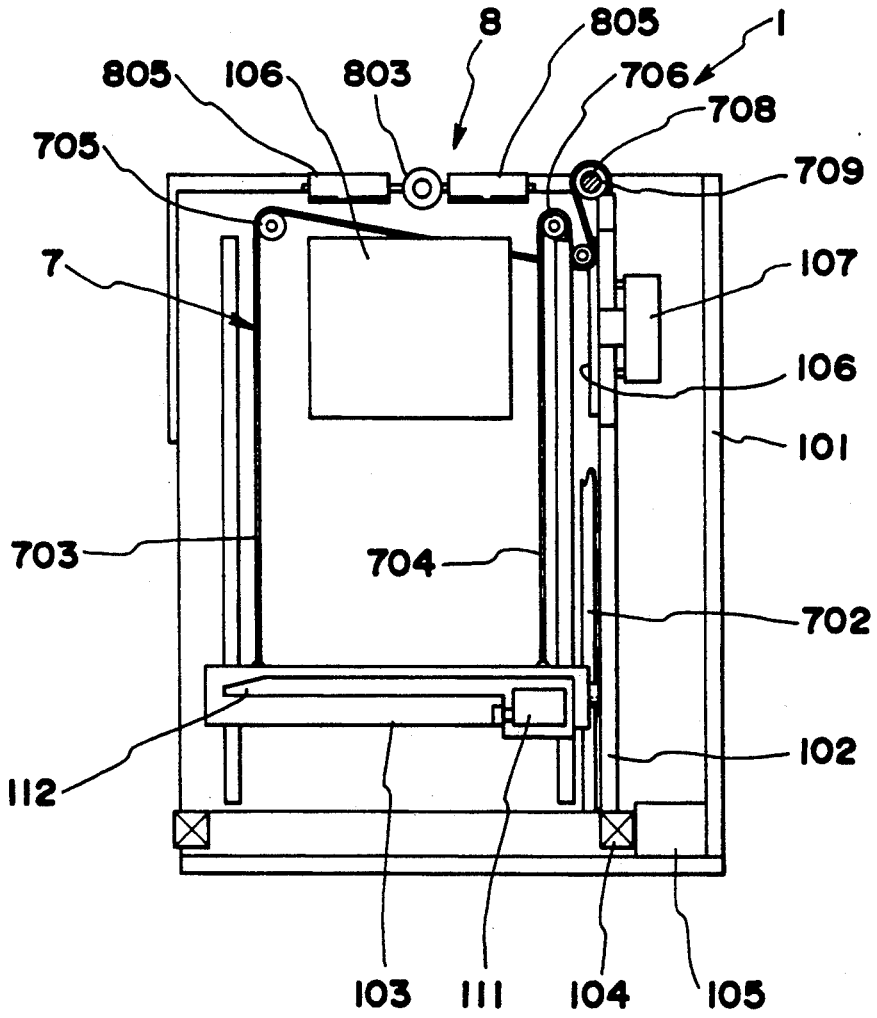
FIG. 4 is a cross-sectional view of the device of FIG. 3 taken along the line IV—IV of FIG. 3.
Figure 5:
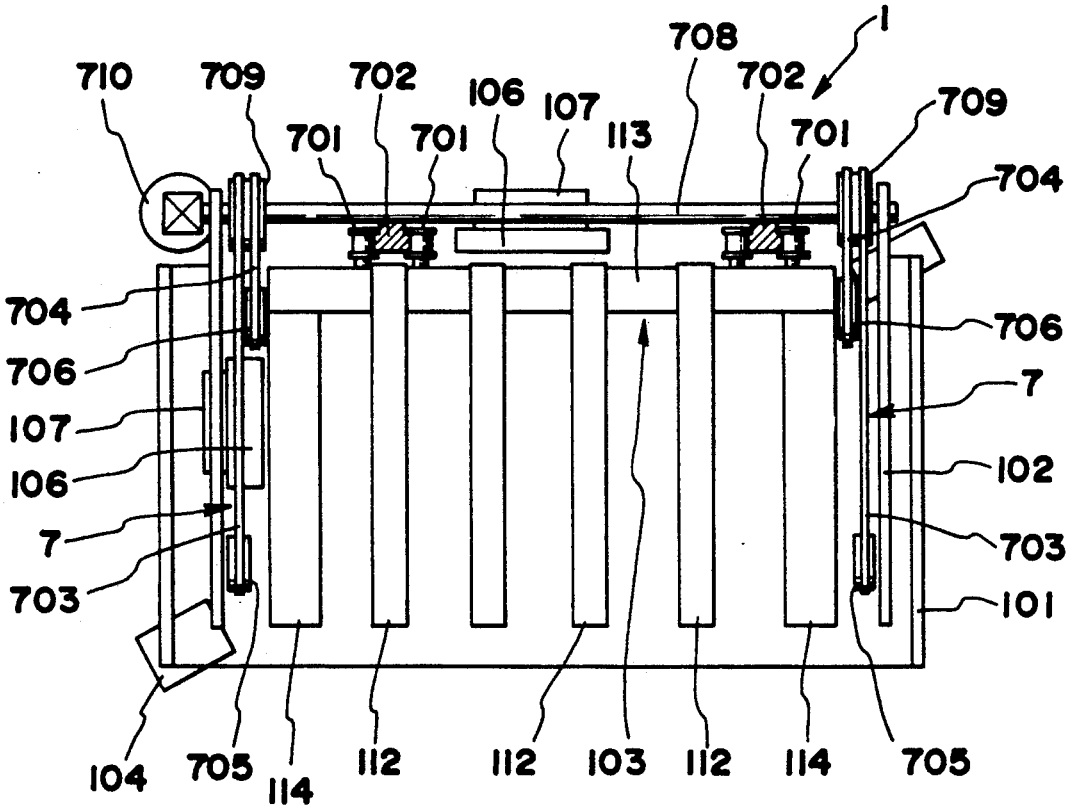
FIG. 5 is a cross-sectional view of the device of FIG. 3 taken along the line V—V of FIG. 3.
Figure 6:
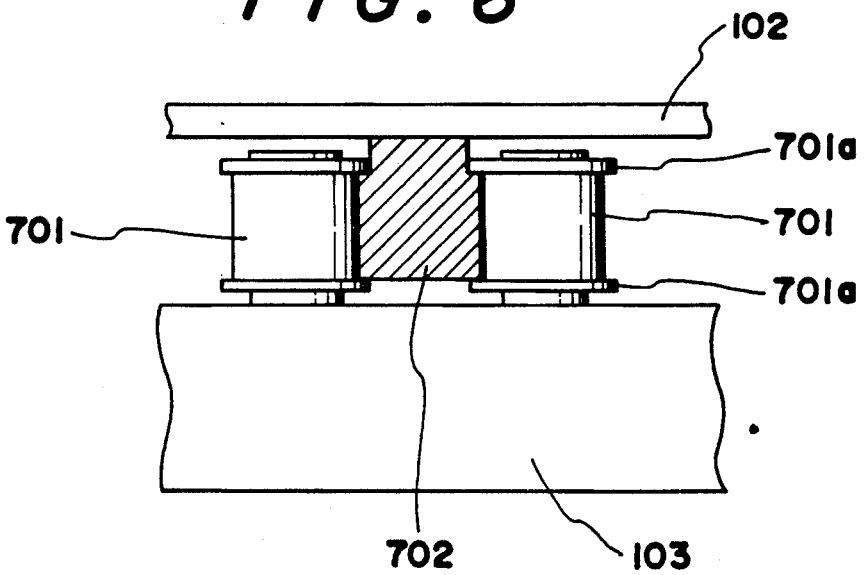
FIG. 6 is a cross-sectional view of the device of FIG. 3 taken along the line VI—VI of FIG. 3.

Continuing further, the numeral 8 denotes a deaeration mechanism provided upon the upper end of paper arranging device 1. Within this mechanism, thrust shaft 802 is disposed in a freely slidable manner within thrust bearing 801 which is fixed upon the upper end of inclined frame 102, as best seen in FIG. 2, and roller shaft 804 is disposed in a freely rotatable manner within bearing piece 803 so as to intersect and define with thrust shaft 802 a substantially T-shaped configuration, bearing piece 803 being disposed upon the free end of thrust shaft 802. Upon roller shaft 804, rollers 805, 805 are disposed in a freely rotatable manner. The thrust shaft 802 is driven by means of a deaeration mechanism drive unit 806 such as, for example, an air cylinder or motor so as to be slidably reciprocable in the direction of Arrow H.

Furthermore, the numeral 9 denotes a mirror for checking the back side of the loaded paper in order to verify the paper feed level B of paper feed rack 2.

The paper arranging system of the above-mentioned apparatus has been developed so as to load a bundle of paper sheets a to be stacked onto paper feed rack 2 through means of paper loading plate b and spacer block c disposed upon lifting frame 202. Such a loading operation can be achieved by adjusting the space between forked rods 112 and inserting a loading fork lift in between the forked rods 112. When paper is loaded upon lifting frame 202 of paper feed rack 2, rotary drive motor 710 for elevating lifting frame 202 is driven so as to ensure that the upper level of paper may be maintained at the paper feed level B. On the other hand, paper arranging device 1 is waiting in the state wherein inclined frame 102 is inclined backwardly by means of tilting drive means 105 while lifting frame 103 is elevated up to the upper limit.

With platform plate 601 of working platform 6 pivoted downwardly from a vertical upright state as a result of driving platform plate kickup motor 606, the worker is able to be stationed upon the working platform so as to perform re-loading of paper bundle a.

In the case where paper bundle a is to be loaded in a normal position from paper feed rack 2 onto paper arranging device 1, paper bundle a is moved from the paper feed level B of paper feed rack 2 onto bridge plate device 3 (at this time, paper bundle a will pass under reversing shaft 403) and is slid over the bridge plate device 3 toward the paper feed level A of paper arranging device 1. By repeating this operation, the stacking of paper sheets can be performed.

On the other hand, reversed paper stacking work is performed as a result of reversing shaft 403 being rotationally driven by means of motor 405. In this case, keeper disk 406 is disposed at the position spaced apart from the periphery of roll 404. First, a proper amount of paper bundle a is moved from the paper feed level B of paper feed rack 2 onto bridge plate device 3 (at this time, paper bundle a will pass under roll 404) and is tentatively placed at the position wherein the trailing end of paper bundle a does not pass beyond reversing shaft 403. Then, the trailing end of the paper bundle a is lifted up and wound around roll 404 in the rotating direction of the roll 404. At the same time, the trailing end of the paper a is guided onto the bridge plate device 3. Also as a result of this winding operation, paper bundle a is still sliding upon the surface of roll 404, but paper detection sensor 413 detects the end of paper a going beyond the upper side of roll 404 and toward paper arranging device 1. By means of this detection output, cam member 409 is rotationally driven by means of control motor 411 through means of the central control unit so as to ensure that keeper disk 406 may be lowered down onto the surface of roll 404. Therefore, since the keeper disk 406 serves to press paper bundle a wound around roll 404 against the surface of the roll 404 under the influence of the biasing force of coil spring 410, the paper bundle a is rolled and conveyed as reversing shaft 403 turns, and is slid over the bridge plate device 3 and thus automatically fed in a reversed state into paper arranging device 1 at paper level A. Upon complete conveyance of paper bundle a, there is no longer any detection signal given generated by means of paper detection sensor 413. Consequently, control motor 411 drives cam piece 409 so as to again act upon the base of support shaft 408, thus causing keeper disk 406 to move apart from the surface of roll 404. By repeating this operation, paper a can be fed in a reversed state into paper arranging device 1 for the purpose of the same therein.

Paper a loaded upon paper arranging device 1 is gradually lowered by means of lifting frame 103 so as to maintain the upper level of the stacked paper at the level A.

Paper loading plate b discharged from paper feed rack 2 upon completion of a predetermined stacking operation is removed by means of a guide roller 506 onto lifting frame 502 of plate holder 5.

Moreover, since the worker can, during the re-loading operation, check the back side of the paper reflected in mirror 9 provided for verifying the paper level at the back side of the loaded paper so as to maintain the paper level at the paper feed level B of paper feed rack 2, he can verify the position of any wrinkled or torn paper.

In the case when the re-loaded paper is to be carried out from paper arranging device 1 after completion of the paper stacking operation, platform plate 601 of working platform 6 is driven by means of platform plate kickup motor 606 to its standup position whereby working platform 6 is effectively removed from the front of paper arranging device 1. In this state, a forklift can be slid between forked rods 112 under lifting frame 103 of paper arranging device 1 to complete the whole process of work.

While the invention has been particularly described with reference to its most preferred embodiment, it will be apparent that various other modifications and changes may be made to the present invention described above without departing from the spirit and scope thereof. Therefore, the present invention is not limited only to its particular embodiments.

What is claimed is:

1. A paper arranging system for re-loading a bundle of paper sheets from a paper feed rack to a paper arranging device, comprising:

a paper feed rack having a front, a rear, and two sides for initially receiving a bundle of paper sheets;

a paper arranging device located adjacent to said paper feed rack for receiving and stacking said bundle of paper sheets after said bundle of paper sheets has been transferred from said paper feed rack to said paper arranging device; means for conveying said paper sheets from said paper feed rack to said paper arranging device;

a working platform pivotably disposed in front of said paper feed rack and said paper arranging device and means for moving said working platform between a first horizontally disposed position at which an operator may be supported thereon for performance of a paper stacking operation, and a second vertically disposed position at which said platform is moved away from said front of said paper feed rack and said paper arranging device so as to provide clear access to said paper feed rack and said paper arranging device.

2. The paper arranging system as set forth in claim 1, wherein said paper feed rack and paper arranging device are placed at an angle with respect to each other.

3. The paper arranging system as set forth in claim 1, wherein:

a plate holder is disposed adjacent to and along the side of said paper feed rack; and a lifting frame disposed within said plate holder for elevating paper support plates in an up and down mode.

4. A paper arranging system as set forth in claim 3, wherein said lifting frame comprises:

a transversely disposed support rod; and a plurality of forwardly extending rods, slidably adjustable upon said transversely disposed support rod so as to predeterminedly adjust the spacing defined between successive ones of said forwardly extending rods, for supporting said paper support plates.

5. The paper arranging system as set forth in claim 1 wherein a mirror for checking the back side of loaded paper is provided in the rear of said paper feed rack so as to verify the paper feed level of said paper stacked within said paper feed rack.

6. A paper arranging system as set forth in claim 1, further comprising:

vibrating means disposed within said paper arranging device for vibrating said paper stacked within said paper arranging device so as to uniformly align at least two sides of said paper sheets, and a corner region defined therebetween, when said paper sheets are stacked upon said paper arranging device.

7. A paper arranging system as set forth in claim 1, further comprising:

bridge plate means interposed between said paper feed rack and said paper arranging device effectively interconnecting said paper feed rack and said paper arranging device so as to support said paper sheets as said paper sheets are transferred and conveyed from said paper feed rack to said paper arranging device.

8. A paper arranging system as set forth in claim 7, wherein:

said bridge plate-means has a substantially arcuate configuration in plan view.

9. A paper arranging system as set forth in claim 7, wherein:

said bridge plate means has a substantially arcuate configuration as seen in elevation.

10. A paper arranging system as set forth in claim 7, wherein said bridge plate means comprises:

a main plate; and a sub-plate telescopically disposed beneath said main plate; and means for moving said sub-plate relative to said main plate so as to lengthen or shorten said bridge plate means in order to bridge any distance defined between said paper feed rack and said paper arranging device.

11. A paper arranging system as set forth in claim 7, wherein said bridge plate means further comprises:

feed roller means rotatably mounted upon said bridge plate means for conveying said paper sheets from said paper feed rack toward said paper arranging device.

* * * * *